US007575035B2

(12) United States Patent
Lee

(10) Patent No.: US 7,575,035 B2
(45) Date of Patent: Aug. 18, 2009

(54) VALENCE JUNCTION FITTING

(76) Inventor: Han-Sen Lee, 98-1, Show-Tsuo St., Show-Tsuo Village, Fu-Hsing Hsiang, Chang-Hwa Hsien (TW)

( * ) Notice: Subject to any disclaimer, the term of this patent is extended or adjusted under 35 U.S.C. 154(b) by 168 days.

(21) Appl. No.: 11/250,565

(22) Filed: Oct. 14, 2005

(65) Prior Publication Data

US 2007/0094970 A1 May 3, 2007

(51) Int. Cl.
*E06B 9/00* (2006.01)

(52) U.S. Cl. ..... 160/38; 52/287.1

(58) Field of Classification Search ..... 52/287.1, 52/288.1, 656.9, 655.1; 160/38, 178.1 V, 160/902, 39, 19
See application file for complete search history.

(56) References Cited

U.S. PATENT DOCUMENTS 1,952,069 A * 3/1934 Hoffheimer et al. ..... 160/39
4,827,683 A * 5/1989 Poole ..... 52/316
5,383,508 A * 1/1995 Pavlica et al. ..... 160/38
6,094,796 A * 8/2000 Biro ..... 29/463
6,526,712 B2 * 3/2003 Brooks et al. ..... 52/287.1
6,539,675 B1 * 4/2003 Gile ..... 52/96
6,659,154 B2 * 12/2003 Bergeron et al. ..... 160/38

* cited by examiner

*Primary Examiner*—Richard E Chilcot, Jr.
*Assistant Examiner*—Chi Q Nguyen
(74) *Attorney, Agent, or Firm*—Curtis L. Harrington; Kathy E. Harrington; Harrington & Harrington

(57) ABSTRACT

A specialized angle valence junction fitting forms a joint for connecting two lengths of valence molding. The fitting has a pair of openings angled apart and has an internal shape matching an external shape of the molding utilized. The specialized angle joint may have a color to match or accent two lengths of molding and has an external dimension which is only about 1.5 millimeters greater than the dimension of the molding which it surrounds. Valence junction fitting can have an end edge which is straight, or beveled to imply a more stabilized or substantial relationship to the molding.

6 Claims, 1 Drawing Sheet

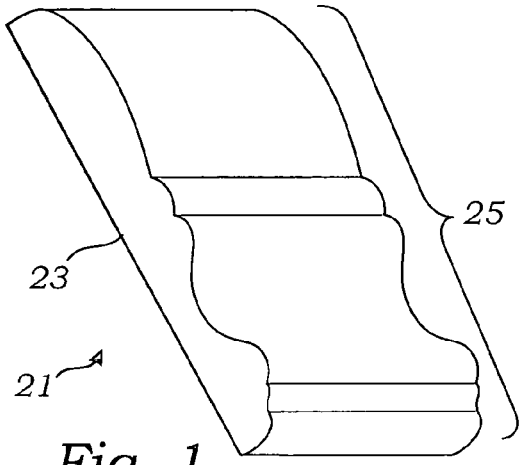
Fig. 1
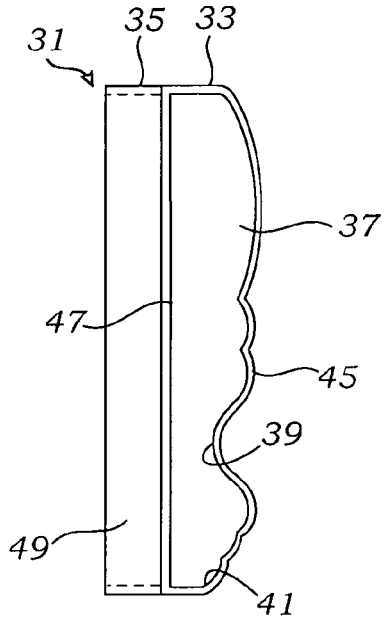
Fig. 2
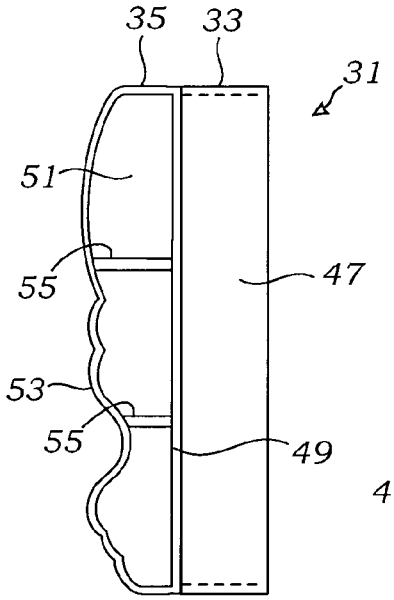
Fig. 3
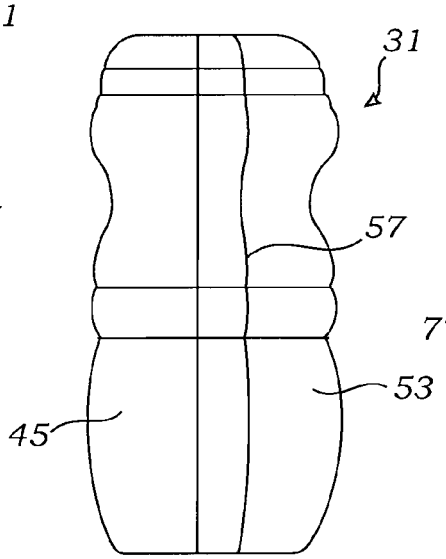
Fig. 5
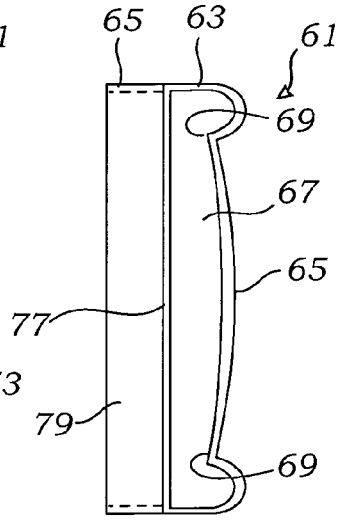
Fig. 6
Fig. 4
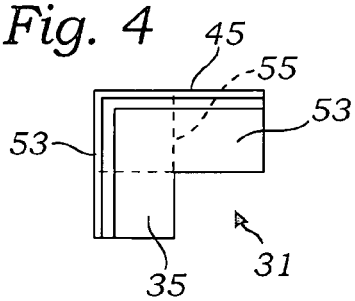
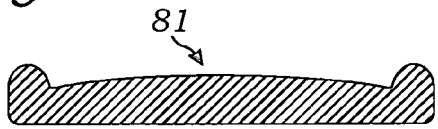
Fig. 7

VALENCE JUNCTION FITTING

FIELD OF THE INVENTION

The present invention relates to an improvement in providing a more customized window covering valence fit while eliminating the need for an exacting miter box with exacting dimensioning and custom installation.

BACKGROUND OF THE INVENTION

Valence structures have traditionally been utilized to complete a window treatment. Custom installed valences require ordering and custom cutting of what is typically a linear molding. Of course, non-extruded style valences can be used which have specific decorative patterns or lengths of constant cross sectional area punctuated with an intermittent pattern, such as a flower or the like. Custom installations with high cost and high labor rates have the relative luxury of custom cutting and fitting and significant scrap. For custom installations, a high scrap rate is tolerable both economically and in terms of availability of a large supply of materials. Conversely, for home installation a high scrap rate creates an intolerable rise in cost, and an impossible expectation that the home installer will have the tools necessary to cut and fit the valence members.

One technique for valence joinder at the corners has been to form a 45° miter cut on each end of the meeting valence so that the outside or inside corners form a 90° angle. A cut also means that a thin, black crack will be left between the two members. The thin, black crack can occur through the edge effect of the saw on cutting, as well as any deviation from a completely planar cut. The alternatives to eliminate the crack are associated with further time and effort on the part of the custom installer. Putty, followed by spot painting can be performed. Complete re-painting of the valence can be accomplished, as well as installation of un-painted valence followed by initial painting.

Another problem with valences is the manner of joining of the segments. Glue can be unsatisfactory and can leave an unsightly appearance. Some valence hardware can include right angle supports which are attached with threaded members. Others utilize slots which accommodate right angle hardware. With these latter two cases, any deviation by the installer can leave a mis-matched angle or mis-matched gap which will require filler, painting, or other space and color correction.

Another problem with the 45° miter cut is the necessity to re-perform this cut for each 90° angle. Where the cut is too short, even by a millimeter, the length of valence must be discarded. Attempted use of any length which is too short or too long will result in corner angles deviating from 90°. Where the ends are 45° miter cut, even larger gaps will result.

Most people who self-install lack a high precision miter saw, but have the ability to cut at an angle orthogonal to the main extent of the valence. Most cuts are not high precision, and self-installers very likely lack the ability to finely sand the ends to insure a match fit. Even where precision cut and sanding are present, the use of a 45° sharp end is more susceptible to dents and nicks during cutting. The production of a sharp edge, especially with the fanciful shape of most valences has the potential to produce even more scrap and wasted time.

What is needed is a simple valence system for self-installers which can utilize cuts orthogonal to lengths of molding, regardless of the shape of the molding. The system should be forgiving of small errors in measurement and sawing, and should provide a finish which is compatible with the molding used and which eliminates open gaps. The system should also be forgiving of angularity and should facilitate an angle which deviates slightly from 90° where needed.

SUMMARY OF THE INVENTION

A specialized angle valence junction fitting forms a joint for connecting two lengths of valence molding. The fitting has a pair of openings directed 90° apart and has an internal shape matching an external shape of the molding utilized. The specialized angle joint may have a color to match or accent two lengths of molding and has an external dimension which is only about 1.5 millimeters greater than the dimension of the molding which it surrounds. Valence junction fitting can have an end edge which is straight, or beveled to imply a more stabilized or substantial relationship to the molding. The fitting can have channels which are uneven to assist in the order of attachment, with the shorter fitting providing the necessity for lesser deflection of a first member to which it is attached in order to interfit with another section of molding, when a shape is being completed. Further, the longer channel can be used to better support a length of molding which is cut slightly short of the target.

The fitting can be affixed by the addition of a threaded member, staple, glue, or an interference fit.

BRIEF DESCRIPTION OF THE DRAWINGS

The invention, its configuration, construction, and operation will be best further described in the following detailed description, taken in conjunction with the accompanying drawings in which:

FIG. 1 is a plan view of a short section of valence showing the fanciful pattern that valence molding is expected to assume;

FIG. 2 is a view looking into one of two flange openings of connector of the valence junction fitting of the invention, with the other connector shown in profile;

FIG. 3 is a view of the valence junction fitting of claim 2 turned ninety degrees and looking into the other of two flange openings of connector of the valence junction fitting of the invention;

FIG. 4 is a top view of the valence junction fitting seen in FIGS. 2 and 3 and illustrating the dimensioning thereof and giving a direct comparison of the flange lengths;

FIG. 5 is an outside plan view of the valence junction fitting seen in FIGS. 2-4 and illustrating the external shape of the valence junction fitting;

FIG. 6 is a view similar to that seen in FIG. 2 and illustrating a valence junction fitting having vertical symmetry; and FIG. 7 is a side view of a constant cross sectional shape material which interfits with the valence junction fitting seen in FIG. 6.

DETAILED DESCRIPTION OF THE PREFERRED EMBODIMENT

The description and operation of the valence junction fitting of the invention will be best begun with reference to FIG. 1 which illustrates a typical, fairly complex surface detail of an extruded valence 21 which can be used for other purposes. The valence 21 is typically a molding made of wood and having an extruded-type design. By "extruded type" it is meant that it may have a constant cross sectional area and profile. The short section is seen in perspective and is seen to have a flat rear side 23, and a front complex surface 25. The front complex surface 25 includes an undulating up and down pattern across one side of a width of the valence 21.

The valence 21 is typically made of wood and may be formed by moving a plank through a shaped planer which selectively removes the wood to yield the shape seen in FIG. 1. Valence 21 could also be made of plastic or other material. It is also understood that the constant cross sectional area shown need not extend over the entire length of the valence 21. For example, a valance 21 could be formed in an intricate pattern having a non-uniform cross sectional area, with only so much of the ends formed in constant cross section as are expected to provide material for cutting. As an example, a six inch diameter rose pattern could be placed at the center of a valence. The rose could be used for the center of the valence with the remaining material to be used for the sides, and the remainder discarded. In a similar fashion, the non-uniform portion of the pattern could take up progressively more of the valence 21 length with remaining portions of the valence 21 length left to provide enough material for the sides. In other words, there needs to be only enough constant cross sectional area as will interfit with a valence junction fitting to be shown in FIG. 2.

Referring to FIG. 2, a plan view of a valence junction fitting 31 is seen. The valence junction fitting 31 has a first flange 33 and a second flange 35. The flanges 33 and 35 are angled ninety degrees apart, but valence junction fitting 31 can have flanges 33 and 35 which have a different angular relationship, including more than ninety degrees for polygonal valence shapes, and less than ninety degrees for triangular and more complex valence shapes.

The flanges 33 and 35 seen in FIG. 2 are annular, each having a shaped bore, the shaped bore 37 of flange 33 being visible. As can be sheen, the overall shape of the flange 33 bore 37 matches the shape of the constant cross section valence 21. Further, the inside dimension of the flange 33 bore 37 closely matches the external dimension and shape of the constant cross section valence 21.

The thickness of the wall of the flange 33 can vary based upon the material utilized. One possibility to make the valence junction fitting 31 out of plastic and this may require a thickness of from one to one and a half millimeters. The flange 33 can be made of thin aluminum or other metal. The material selected may be specially prepared to support paint, appliques or other color and pattern bearing structures.

The inside of the bore 37 may be so open as to allow the material of the valence 21 to continue into the flange 33 and extend to the outer wall of the flange 35, or an interference structure could be added within the bore 37 to cause the valence 21 to stop short of any potential interference with the section of valence 21 extending through the flange 35 which might otherwise extend through to contact with the inner wall of the flange 33.

Where the path of occupation of the lengths of valence material can interfere, the individual cutting the valence 21 may take to account which valence sections are to be made to overlap. Further, in terms of layout, the valence material 21 may be cut so that one flat cut end of one length of material will touch the side of another. This will aid in layout and cutting, and will preclude the individual installing the valence system from having to add or account for an inner dimension within the valence junction fitting 31 in which the valence 21 may not extend.

As can be seen in FIG. 2, the amount of overlap within the valence junction fitting 31 will be no deeper within the flange 35 than the nearest point of the back wall of flange 33 and which is seen by an innermost point of a curved portion 39, or possibly a curvature of a bottom inside corner 41. Where such overlap is possible, the installer can either account for such overlap, or cut the lengths of valence 21 to leave the corner of the valence junction fitting 31 un-occupied.

In the alternative, small stop structures can be molded or added to the inside of the valence junction fitting 31 to force the inside corner of the valence junction fitting 31 to remain unoccupied. It may be useful to have an indication of the un-occupied space indicated to the user or perhaps faintly marked on the outside of the valence junction fitting 31.

As by example, a typical valence 21 having a width of about three to four centimeters and a thickness at its shortest dimension of about 0.7 cm will give a difference of about 0.5 cm. In other words when one valence 21 is backed out of the common space to an extent that such movement just clears the common space, the other valence 21 can move forward by the same amount, which is about 0.5 cm for a valence 21 and the valence junction fitting 31. FIG. 2 also illustrates other details of valence junction fitting 31, including flange 33 outside wall 45, flange 33 inside wall 47. Also seen is flange 35 inside wall 49.

Referring to FIG. 3, a view of the valence junction fitting 31 is seen similar to that seen in FIG. 2, but turned ninety degrees. The view of FIG. 2 was one looking into the bore 37 of first flange 33. The view of FIG. 3 looks directly into a shaped bore 51 of flange 35 with flange 33 seen extending to the right. An outside wall 53 is seen, similar to outside wall 45. The outside walls 45 and 53 extend to an adjacent corner line 57. The corner line 55 will have a shape proportional to the outside shapes of the valence 21. The shapes of the outside walls 45 and 53 surrounding the corner line 55 are a mirror images of each other.

Comparing FIG. 2 and FIG. 3, it can be seen that Flange 33 may be a little longer than flange 35. This can be the case regardless of whether the space within the valence junction fitting 31 will provide an overlap space within which the ends of the valences 21 can compete. Such differences in the lengths of flanges can accomplish several objectives. First, different lengths of flanges 33 and 35 can help the user in fitting the longer length flange first, and then provide a lesser length of flange causing reduced bending of the last length of extruded valence to complete a closed shape before fitting the shorter length flange. Of course, both flanges 33 and 35 can be made of the same length, the difference in length being shown to emphasize all possibilities.

For example, where a valence box structure is made by extending two lengths of valence 21 from the wall and joining the front length of valence, the longer flanges 33 might be directed in the direction toward the wall and perpendicular to the plane of the wall, so that a smaller angular deflection of the lengths of valence 21 extending from the wall could be used to make the final inserted construction. Regardless of the lengths of the flanges 33 and 35, the arrangement of which of two competing ends of two valences 21 which occupy the corner of the valence junction fitting 31 is made by the installer by simply backing one of the valences 21 from the corner most position and allowing the other valence 21 to occupy the corner. The slightly greater width of flange 33 with respect to flange 35 is normally not visually discernible in a rectangular valence application.

A second reason for having different flange lengths may relate to a competing occupancy within the valence junction fitting 31 where the inside of the valence junction fitting 31 allows extruded valence 21 inserted within the valence junction fitting 31 to compete for the space at the apex of the two flange bores 37 and 51. Where it is desired to have equal support of the valence 21 by the valence junction fitting 31, a longer flange should be provided to secure the section of valence 21 not occupying the corner-most occupancy within the valence junction fitting 31. This side is the "backed off" section of valence, and by providing it a longer flange 33 it will derive about the same support as the shorter flange 35. Again, the slightly greater length of flange 33 with respect to flange 35 is normally not visually discernible in a rectangular valence application.

Again, both flanges 33 and 35 can be of the same length, and where the length of the flanges 33 and 35 are more than sufficient to support the valence material 21, the use of even length flanges will give a more balanced appearance. Further, the use of flanges 33 and 35 which are of the same length, and which are more than sufficient for support of either the backed off valence 21 or the valence 21 occupying the corner position of the valence junction fitting 31, enables a user to select which of the valences 21 which will occupy the corner-most position in the valence junction fitting 31 in order to make a final adjustment for any length of valence 21 which was cut inadvertently too long or too short. For example, where the lengths of two valences 21 line up to complete a corner where one is slightly longer than the other, it can be selected to occupy the "common space" or corner-most section of the valence junction fitting 31.

The valence junction fitting 31 of FIGS. 2 and 3 interfits with the valence 21 of FIG. 1. Note that the pattern is not symmetrical with respect to a midpoint of the width of the valence 21. In this case it would be desirable to make valence junction fittings 31 with the same pattern and in half the cases with flange 35 longer than flange 33 and half with flange 33 longer than flange 35. As before, both flanges 33 and 35 may be of the same length. In the case where the flanges are of the same length only one version of valence junction fitting 31 need be made.

Also shown is a pair of optional internal depth limiting members 55 which may be employed where it is desired to limited the extent to which the valence 21 can be inserted into the valence fitting 31. The depth limiting members 55, based upon their corner position within the valence fitting 31 will also act to limit the depth to which valence 21 can be inserted into flange 33.

Referring to FIG. 4, a bottom view of the valence junction fitting 31 seen in FIGS. 2 and 3 emphasize the relative lengths of the flanges 33 and 35. FIG. 4 also illustrates that the patterns converge at an outside corner and that the outside corner is not vertically linear. FIG. 4 also illustrates the geometric extent of the optional internal depth limiting members 55. FIG. 5 illustrates an angled plan view which illustrates various lines of the pattern seen in the other figures.

Referring to FIG. 6, an example of a smaller, symmetrical valence junction fitting 61 is seen with the same type of view seen in FIG. 2. The valence junction fitting 61 has a first flange 63 and a second flange 65. The flanges 63 and 65 are also annular, each having a shaped bore, bore 67 of flange 63 being visible. Other structures are similar to the structures seen with respect to valence junction fitting 31 and includes pair of innermost points 69 which may set the maximum extent to which a matching valence (not shown) could enter flange 65 and extend toward an outside wall 65. Further structures include flange 63 inside wall 77 and flange 65 inside wall 79. In this configuration, if the length of the flanges 63 and 65 are different, the valence junction fitting 61 can simply be inverted top to bottom and rotated to present the other of the flanges 63 and 65 to a length of valence or molding.

Referring to FIG. 7, a side view of a valence 81 illustrates a constant cross sectional shape compatible with the valence junction fitting 61 seen in FIG. 6. In the case of both o the valence junction fittings 31 and 61, a seeming line across the height of the valence 21 or 81 may be created by the thickness of the side walls 45, 53, or 65. The prominence of the line will be determined by the thickness of the side walls 45, 53, or 65, their coloring, and the relative size and complexity of the valence 21 and 81. The valence junction fittings 31 and 61 will appear as corner thickenings. Further, there is no limit on the axial length of the flanges 33, 35, 63 and 65. Where the flanges 33, 35, 63 and 65 have an expanded length, the flange can begin to assume a predominant part of the design.

Another desirable effect for the valence junction fittings 31 and 61 is the use of a high finish. A high finish can be achieved by utilizing a metallic material of construction and applying a high polish. Brass, silver, gold or other material can be used. Vacuum metalization can be applied to plastic to give the same high reflective finish as metal, and will give a wider range of color choice. In this case, the valence junction fittings 31 and 61 will appear as if they were binding fittings. Other finishes can be applied to the valence junction fittings 31 and 61 to help match the pattern of the valences 21 and 81.

While the present invention has been described in terms of a valence junction fitting having a pair of orthogonally extended flanges, the present invention can be used in any situation where a balance between ease of structural construction is to be struck with providing a high degree of the appearance of a custom finish. One skilled in the art will realize that the structure and techniques of the present invention can be applied to many structures, including any structure where the above goals can be achieved by the above goals in an interfitting manner.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed:

1. A junction fitting assembly comprising:

at least a first and a second lengths of material having a first constant cross sectional area including a first external surface having a mold pattern;

a first annular flange having a first internal surface complementary to the mold pattern and having a second constant cross sectional shape along at least a portion of its axial length, said first annular flange having at least a first external surface on an opposite side of the first annular flange with respect to the first internal surface, and following a first shape of a portion of said first internal surface of said first annular flange, said first annular flange having a first annular opening for admitting and continuously fitting around said first constant cross sectional area of said first length of material;

a second annular flange having a second internal surface complementary to the mold pattern and having a third constant cross sectional shape along at least a portion of its axial length, said second annular flange having at least a second external surface on an opposite side of the first annular flange with respect to the first internal surface, and following a second shape of a portion of said first internal surface of said second annular flange, said second annular flange having a second annular opening for admitting and continuously fitting around said first constant cross sectional area of said second length of material; said second annular flange joined to said first annular flange, said first external surface of said first annular flange and said second external surface of said second annular flange joining at a corner to form said junction fitting, the junction fitting attachable to each of said first and said second lengths of material by insertion of each of said first and said second lengths of material into their associated annular opening of said junction fitting whereby the junction fitting enables the first and said second lengths of material to structurally reinforce each other, said junction fitting having an external shape portion which differs from the mold pattern of at the first and second lengths of material by only the thickness of the first external surface of the first annular flange.

2. The valence junction fitting assembly as recited in claim 1 wherein each of said first and said second annular flanges have a thickness of about one and a half millimeters.

3. The valence junction fitting assembly as recited in claim 1 wherein an internal junction of said first and said second annular flanges allows an end of a first length of material having a constant cross sectional area to contact a second length of material having a constant cross sectional area.

4. The valence junction fitting assembly as recited in claim 3 wherein said internal junction of said first and said second annular flanges allows preferential occupation of said first length of material having a constant cross sectional area over said second length of material having a constant cross sectional area.

5. The valence junction fitting assembly as recited in claim 1 wherein an angle of said first annular flange with respect to said second annular flange is about 90°.

6. The valence junction fitting assembly as recited in claim 1 wherein the first annular flange has a third, generally planar internal surface which opposes the first internal surface of the first annular flange and wherein the second annular flange has a third, generally planar internal surface which opposes the second internal surface of the second annular flange.

* * * * *